US010384094B1

(12) United States Patent
Newman

(10) Patent No.: US 10,384,094 B1
(45) Date of Patent: Aug. 20, 2019

(54) ELASTIC CORD WITH SAFETY SLEEVE

(71) Applicant: Timothy D. Newman, Gulf Shores, AL (US)

(72) Inventor: Timothy D. Newman, Gulf Shores, AL (US)

( * ) Notice: Subject to any disclaimer, the term of this patent is extended or adjusted under 35 U.S.C. 154(b) by 0 days.

(21) Appl. No.: 16/231,759

(22) Filed: Dec. 24, 2018

Related U.S. Application Data

(60) Provisional application No. 62/610,143, filed on Dec. 22, 2017.

(51) Int. Cl.
*A63B 21/055* (2006.01)
*A63B 21/00* (2006.01)

(52) U.S. Cl.
CPC ..... *A63B 21/0557* (2013.01); *A63B 21/0004* (2013.01)

(58) Field of Classification Search
CPC ..... A63B 21/0004; A63B 21/00043; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/15; A63B 21/151; A63B 21/16; A63B 21/4023; A63B 21/4025; A63B 21/4027; A63B 21/4033; A63B 21/4034; A63B 21/4035; A63B 21/4043; A63B 71/0054; A63B 2071/0063; A63B 2071/0072; A63B 2071/0081; A63B 2071/009; A63B 2209/00; A63B 2209/10; A63B 2209/14; A63B 2225/09; A63B 2225/093; Y10T 403/50; Y10T 403/51; Y10T 403/54; Y10T 403/66
See application file for complete search history.

(56) References Cited

U.S. PATENT DOCUMENTS 4,373,503 A * 2/1983 Saunders ..... F41B 3/02 124/20.1
4,544,155 A * 10/1985 Wallenbrock ..... A63B 21/04 473/213
4,694,541 A * 9/1987 Skyba ..... F16F 1/46 24/300
4,733,862 A 3/1988 Miller
(Continued)

*Primary Examiner* — Gary D Urbiel Goldner
(74) *Attorney, Agent, or Firm* — Quickpatents, LLC; Kevin Prince

(57) ABSTRACT

A connection arrangement between at least one end of a flexible strap and a proximal end of an elastic tube comprises a plug adapted for insertion into the proximal end of the elastic tube, the plug having a tapered distal end and a proximal end that has an enlarged head. A distal end of a flexible sleeve receives the proximal end of the plug and the proximal end of the elastic tube therein. A proximal end of the flexible sleeve receives the at least one end of the flexible strap and is fixed thereto with a first fastener. A second fastener fixes the distal end of the flexible sleeve to the proximal end of the elastic tube and the plug. A safety sleeve is disposed over the elastic tube, the plug, and at least a portion of the flexible sleeve, and fixed thereto with a third fastener.

15 Claims, 5 Drawing Sheets

(56) References Cited

U.S. PATENT DOCUMENTS

D330,398 S * 10/1992 Bale ..... A63B 21/0552 D21/672
5,205,803 A 4/1993 Zemitis
5,681,248 A * 10/1997 Vani ..... A63B 21/0004 482/10
5,800,322 A 9/1998 Block
5,885,196 A 3/1999 Gvoich
6,202,263 B1 3/2001 Harker
7,175,574 B2 * 2/2007 Carmel ..... A63B 21/0004 482/124
D580,257 S * 11/2008 Squyres ..... A63B 21/0004 D8/349
7,695,413 B1 * 4/2010 Cruz ..... A63B 21/04 482/126
7,794,374 B1 9/2010 Park
7,909,748 B2 * 3/2011 Calvagne ..... A63B 7/02 482/143
8,075,461 B2 12/2011 Terry
8,105,215 B2 1/2012 Wang
8,348,814 B1 * 1/2013 Hinds ..... A63B 7/02 482/82
8,657,727 B1 * 2/2014 Kassel ..... A63B 21/0552 24/300
D741,419 S * 10/2015 Cohen ..... A63B 21/0004 D21/662
10,232,212 B1 * 3/2019 Cohen ..... A63B 21/0552
2005/0113220 A1 * 5/2005 Dovner ..... A63B 21/0004 482/121
2005/0113221 A1 * 5/2005 Dovner ..... A63B 21/0004 482/121
2005/0113222 A1 * 5/2005 Dovner ..... A63B 21/0004 482/121
2005/0113223 A1 * 5/2005 Dovner ..... A63B 21/0004 482/121
2005/0113224 A1 * 5/2005 Dovner ..... A63B 21/0004 482/121
2005/0113225 A1 * 5/2005 Dovner ..... A63B 21/0004 482/121
2005/0252717 A1 * 11/2005 Farrah ..... A63B 21/153 182/3
2006/0052223 A1 3/2006 Terry
2007/0155600 A1 * 7/2007 Cunningham ..... A63B 21/0004 482/126
2011/0092347 A1 4/2011 Kassel
2012/0267403 A1 * 10/2012 Ward, Jr. ..... A45F 5/00 224/219
2012/0302406 A1 * 11/2012 Hinds ..... A61B 5/224 482/8
2014/0073496 A1 * 3/2014 Bannerman ..... A63B 21/0552 482/139
2014/0323271 A1 * 10/2014 Hinds ..... A63B 21/0442 482/8
2015/0297947 A1 * 10/2015 Morton ..... A63B 23/0355 482/124
2017/0028245 A1 * 2/2017 Williams ..... A63B 21/0557

* cited by examiner

ELASTIC CORD WITH SAFETY SLEEVE

CROSS-REFERENCE TO RELATED APPLICATIONS

This application claims the benefit of U.S. Provisional Patent Application 62/610,143, filed on Dec. 22, 2017, and incorporated herein by reference.

STATEMENT REGARDING FEDERALLY SPONSORED RESEARCH AND DEVELOPMENT

Not Applicable.

FIELD OF THE INVENTION

This invention relates to cords, and more particularly to a connection arrangement between a strap and an elastic tube resulting in an elastic cord with a safety sleeve.

BACKGROUND

There are many applications for connecting a length of elastic tubing or cord to a strap, hook, handle, or other implement. One example is with the commonly used "bungee cord." Many of the prior art connection arrangements are unreliable and unpredictable because the connectors between the implement and the elastic tube can break without warning. The elastic cord stores energy which is suddenly released upon failure of the connection arrangement between the elastic tube and the strap or implement, resulting in a high-speed whipping hazard. When the connector fails, the results can be catastrophic grave injuries to a user or bystander, particularly to the eyes.

The prior art covers many types of connector arrangements between straps or implements and an end of an elastic tube. See, for example, U.S. Pat. No. 5,205,803 to Zemitis on Apr. 27, 1993; U.S. Pat. No. 6,202,263 to Harker on Mar. 20, 2001; and U.S. Pat. No. 7,794,374 to Park on Sep. 14, 2010.

Some of the connector arrangements described include embodiments such a "knot," "crimp," "tie-on," "synch tie," "tuck in," and "strap extension." These referenced connection arrangements, however, fail to provide protective mechanisms against wear between the vulnerable contact connection areas of the elastic tube and sharp corners or points of neighboring elements, or creases or stress points in the elastic tube itself.

Therefore, there is a need for an arrangement of connecting one or both ends of an elastic cord to a strap, hook, handle or other implement that is more reliable than those found in the prior art. Such a connection arrangement would provide for repeated expansion and subsequent retraction of the elastic cord without failure. Further, such a needed improvement would be relatively inexpensive and simple to manufacture. The present invention accomplishes these objectives.

SUMMARY OF THE INVENTION

The present invention is a connection arrangement between at least one end of a flexible strap and a proximal end of an elastic tube. The connection arrangement is useful for securing the flexible strap to the elastic tube in the manufacture of elastic cords, such as the so-called bungee cord, exercise resistance bands, cargo straps, and the like.

The connection arrangement comprises a plug adapted for insertion into the proximal end of the elastic tube. The plug has a tapered distal end and a proximal end that has an enlarged head sized such that the proximal end of the elastic tube is stretchable over the enlarged head.

A flexible sleeve is open at both ends thereof. A distal end of the flexible sleeve is adapted for receiving the proximal end of the plug and the proximal end of the elastic tube therein. The proximal end of the flexible sleeve is adapted for receiving the at least one end of the flexible strap therein and fixed thereto with a first fastener.

A second fastener, such as a metallic crimp ring, is adapted for fixing the distal end of the flexible sleeve to the proximal end of the elastic tube and the plug between the tapered distal end and the enlarged head of the plug, preferably along a proximal cylindrical section of the plug proximate the enlarged head. As such, the at least one end of the flexible strap is connected with the elastic tube evenly around a perimeter of the elastic tube at the second fastener, the elastic tube being exposed only to smooth surfaces.

A safety sleeve is disposed over the elastic tube, the plug, and at least a portion of the flexible sleeve. The safety sleeve is fixed at one open end thereof to the flexible sleeve with a third fastener, such as stitching, The connection arrangement is preferably utilized twice on each end of the elastic tube, thereby forming the elastic cord. Preferably in such an arrangement each flexible strap is formed into a loop with both ends fixed with the flexible sleeve and the safety sleeve. As such, each loop may further include either a carabiner, a handle, a metallic ring, a hook or the like. A variety of different configurations of such implements may be utilized on either end of the elastic cord, as desired. Clearly the length of the elastic cord and the safety sleeve may also be cut to any suitable length depending on the application at hand.

The present invention is an arrangement of connecting one or both ends of an elastic cord to a strap, hook, handle or other implement that is more reliable than those found in the prior art. The present invention provides for repeated expansion and subsequent retraction of the elastic cord without failure, subjecting the elastic tube only to smooth surfaces during use. Further, the present device is relatively inexpensive and simple to manufacture. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
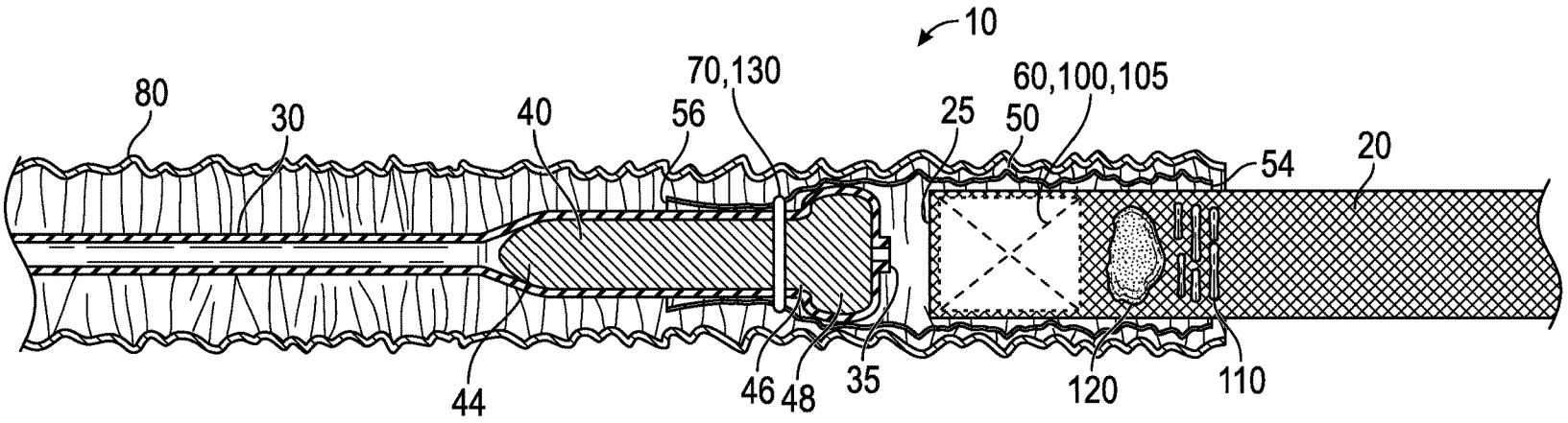
FIG. 1 is a cross-sectional view of a connection arrangement between an elastic tube and a flexible strap, taken a long line 1-1 of FIG. 3.
Figure 2:
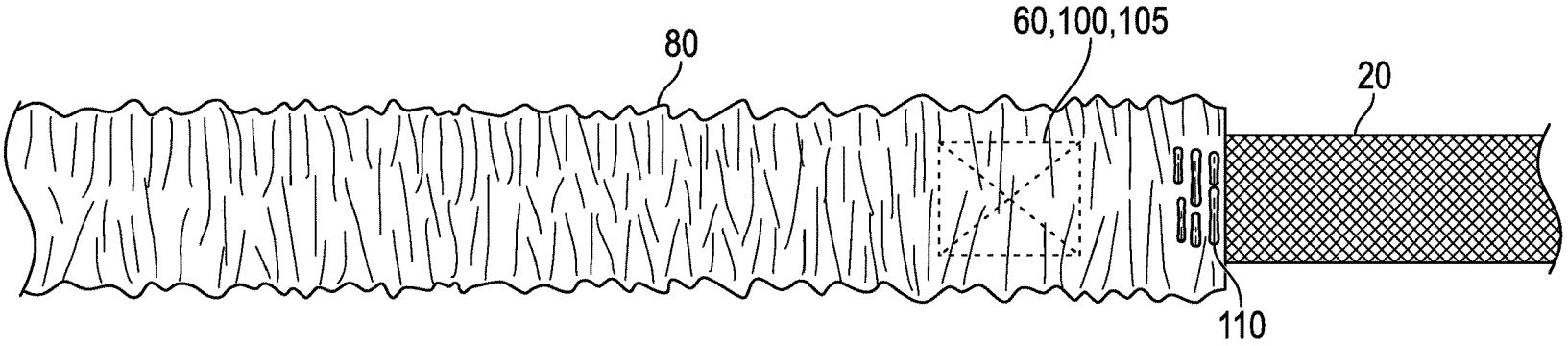
FIG. 2 is a front elevational view thereof.
Figure 3:
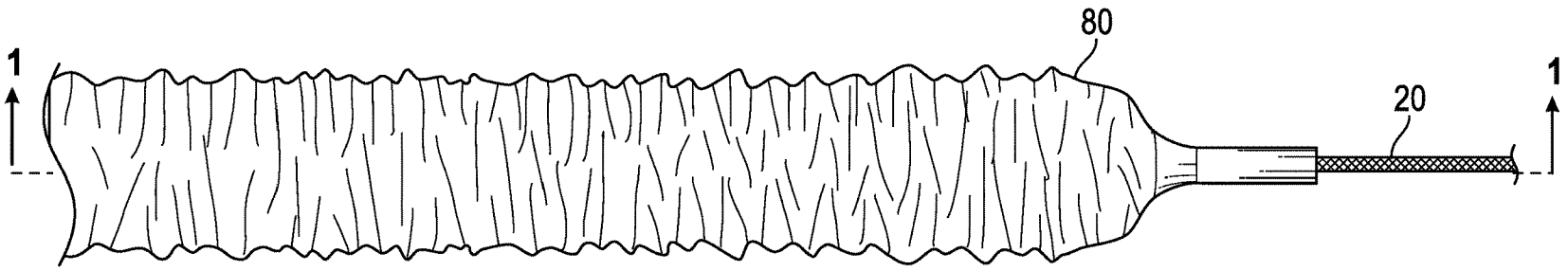
FIG. 3 is a top plan view thereof.

FIGS. 1-3 illustrate a connection arrangement 10 between at least one end 25 of a flexible strap 20, and a proximal end of an elastic tube 30, such as a length of rubber surgical tubing for example. The connection arrangement 10 is useful for securing the flexible strap 20 to the elastic tube 30 in the manufacture of elastic cords 11, such as the so-called bungee cord, exercise resistance bands, cargo straps, and the like.

Figure 4:
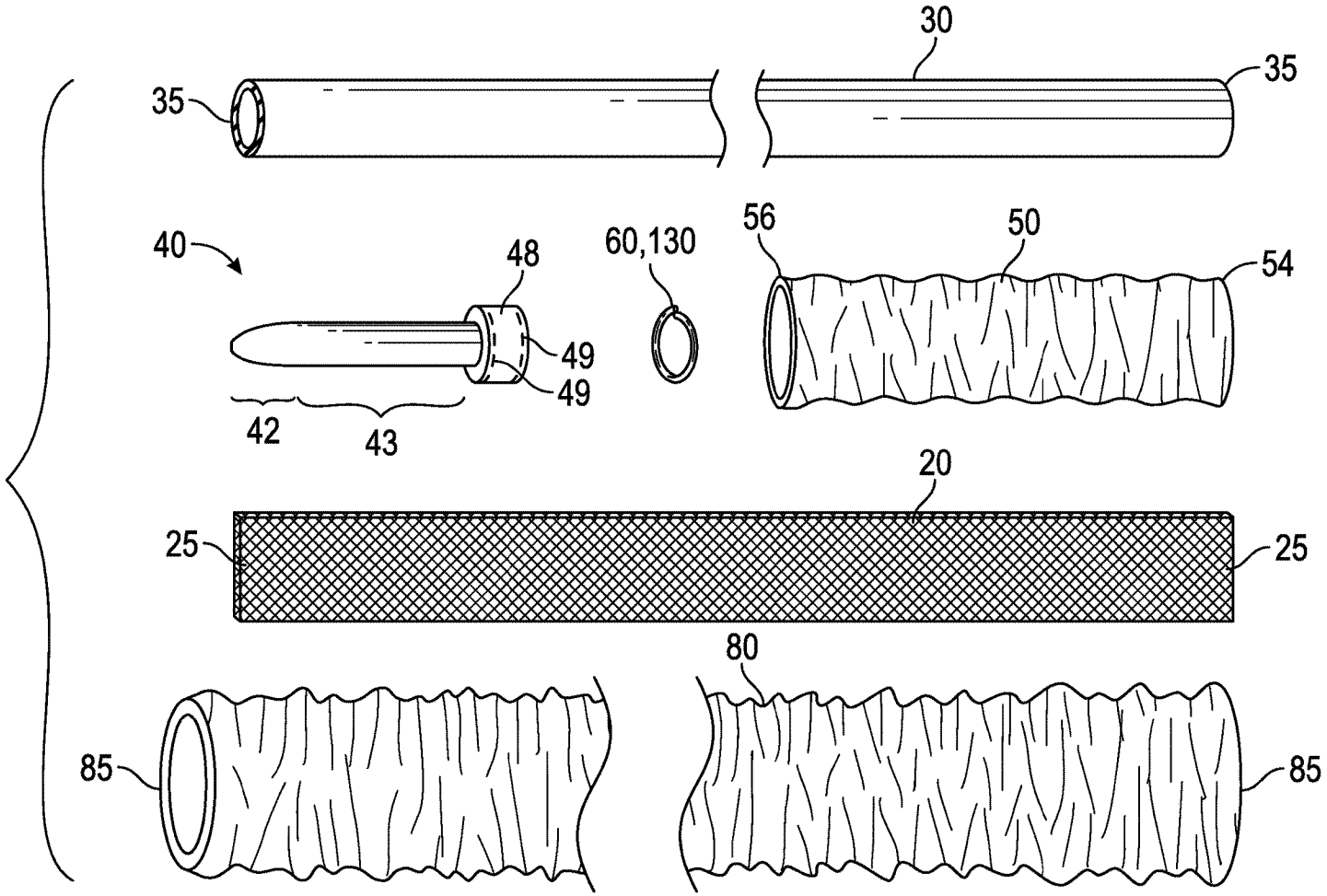
FIG. 4 is an exploded view of the components of the invention.

The connection arrangement 10 comprises a plug 40 adapted for insertion into the proximal end 35 of the elastic tube 30. The plug 40 has a tapered distal end 44 and a proximal end that has an enlarged head 48 sized such that the proximal end 35 of the elastic tube 30 is stretchable over the enlarged head 48. Preferably the distal end 44 of the plug 40 is generally bullet shaped, having a proximal cylindrical section 43 and a distal tapered section 42 that has an increasing taper to the distal end 44 of the plug 40 (FIG. 4). The proximal cylindrical section 43 is preferably at least twice as long as the tapered section 42 of the distal end 44 of the plug 40. The enlarged head 48 of the plug 40 is preferably generally cylindrical in shape and has rounded edge 49 so as to present only smooth surfaces to an inside surface of the elastic tube 30 (FIGS. 1 and 4). The plug 40 is preferably made from a rigid, non-compressible material such as ABS, PVC, ballistic nylon, metal such as aluminum, steel, or the like, having a Shore D hardness of preferably over 60.

A flexible sleeve 50 is open at a distal end 56 thereof and at a proximal end 54 thereof. The distal end 56 of the flexible sleeve 50 is adapted for receiving the proximal end 46 of the plug 40 and the proximal end 35 of the elastic tube 30 therein. The proximal end 54 of the flexible sleeve 50 is adapted for receiving the at least one end 25 of the flexible strap 20 therein and fixed thereto with a first fastener 60, such as stitching, preferably in an X-box pattern 105 as illustrated. Alternately the first fastener 60 may be a sonic weld 110 (FIG. 1) between the at least one end 25 of the flexible strap 20 and the flexible sleeve 50, or alternately an adhesive 120 such as a strong epoxy resin or the like, or any combination of the stitching 100, sonic weld 110 and adhesive 120. The flexible sleeve 50 is preferably made from a flexible, non-stretchable material such as nylon webbing, polypropylene, plastic or the like.

A second fastener 70, such as a metallic crimp ring 130, a plastic zip-tie (not shown), a metal clamp (not shown), band, or the like, is adapted for fixing the distal end 56 of the flexible sleeve 50 to the proximal end 35 of the elastic tube 30 and the plug 40 between the tapered distal end 44 and the enlarged head 48 of the plug 40, preferably along the proximal cylindrical section 43 proximate the enlarged head 48. As such, the at least one end 25 of the flexible strap 20 is connected with the elastic tube 30 evenly around a perimeter of the elastic tube 30 at the second fastener 70, the elastic tube 30 being exposed only to smooth surfaces.

A safety sleeve 80 is disposed over the elastic tube 80, the plug 40, and at least a portion of the flexible sleeve 50. The safety sleeve 80 is fixed at one open end 85 thereof to the flexible sleeve 25 with a third fastener 90, such as stitching, preferably in the X-box pattern 105. Alternately the third fastener 90 may be a sonic weld 110 (FIG. 1) between the at least one end 25 of the flexible strap 20 and the flexible sleeve 50, or alternately an adhesive 120 such as a strong epoxy resin or the like, or any combination of the stitching 100, sonic weld 110 and adhesive 120. In some embodiments the first fastener 60 and the third fastener 90 are unitary. The safety sleeve 80 is pleated or bunched-up, and made from a flexible, non-stretchable material such as woven nylon webbing, polypropylene, or other plastic or puncture-resistant materials. If the elastic tube 30 breaks within the safety sleeve 80, the safety sleeve 80 is adapted to prevent the elastic tube 30 or any of the components internal to the safety sleeve 80 from puncturing the safety sleeve 80, thereby reducing the threat of injury or property damage if the elastic tube 30 or connection arrangement 10 fails. When fully extended and substantially flat and smooth, the safety sleeve 80 is sized so that it is shorter than the maximum safe extension length of the elastic tube 30.

Figure 5:
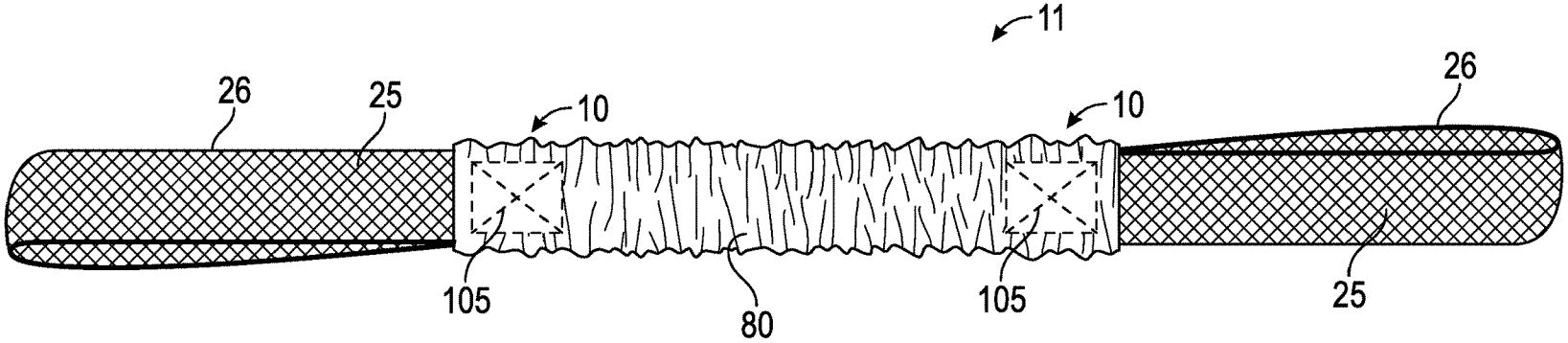
FIG. 5 is a front view of an embodiment of the invention wherein each end of the elastic cord terminates with a looped flexible strap.
Figure 6:
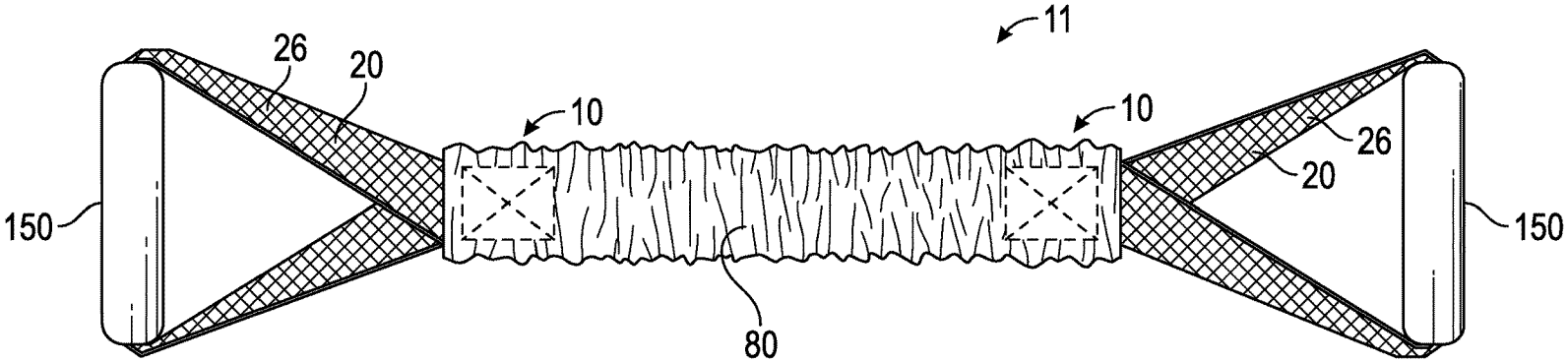
FIG. 6 is a front view of an embodiment of the invention wherein each end of the elastic cord terminates with a handle.
Figure 7:
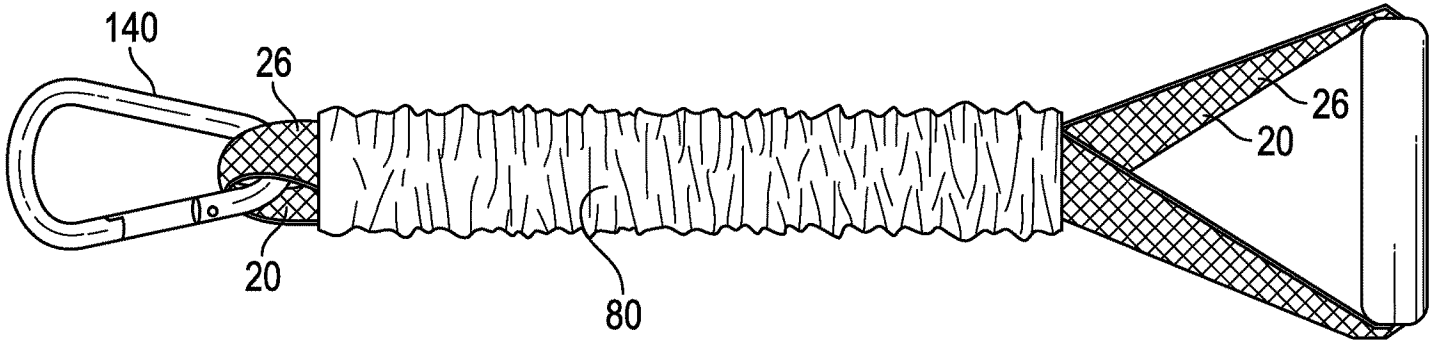
FIG. 7 is a front view of an embodiment of the invention wherein one end of the elastic cord terminates with the handle and the opposing end of the elastic cord terminates at a carabiner.
Figure 8:
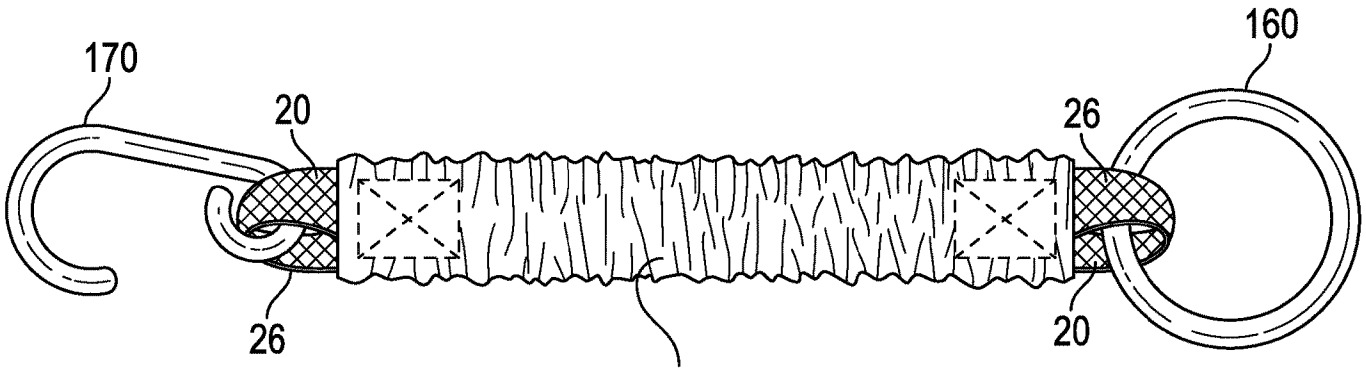
FIG. 8 is a front view of an embodiment of the invention wherein one end of the elastic cord terminates with a hook and the opposing end of the elastic cord terminates at a metallic ring.

The connection arrangement 10 is preferably utilized twice on each end 35 of the elastic tube 30, thereby forming the elastic cord 11. Preferably in such an arrangement each flexible strap 20 is formed into a loop 26 (FIG. 5) with both ends 25 fixed with the flexible sleeve 50 and the safety sleeve 80. As such, each loop 26 may further include either a carabiner 140 (FIG. 7), a handle 150 (FIGS. 6 and 7), a metallic ring 160 (FIG. 8), a hook 170 (FIG. 8) or the like. A variety of different configurations of such implements may be utilized on either end of the elastic cord 11, as desired. Clearly the length of the elastic cord 30 and the safety sleeve 80 may also be cut to any suitable length depending on the application at hand.

A method of connecting at least one end 25 of the flexible strap 20 with the proximal end 35 of the elastic tube 30 comprises the steps:

a) providing the plug 40 adapted for insertion into the proximal end 35 of the elastic tube 35, the plug 40 having the tapered distal end 44 and the proximal end 46, the proximal end 46 having the enlarged head 48;

b) inserting the tapered distal end 44 of the plug 40 into the proximal end 35 of the elastic tube 30 and stretching the proximal end 35 of the elastic tube 30 over the enlarged head 48;

c) providing the flexible sleeve 50 open at the distal end 56 thereof and at the proximal end 54 thereof;

d) inserting the at least one end 25 of the flexible strap 20 into the proximal end 54 of the flexible sleeve 50 and fixing the at least one end 25 of the flexible strap 20 to the proximal end 56 of the flexible sleeve 50 with the first fastener 60;

e) inserting the proximal end 46 of the plug 40 and the proximal end 35 of the elastic tube 30 into the distal end 56 of the flexible sleeve 50;

f) fixing the distal end 56 of the flexible sleeve 50 to the proximal end 35 of the elastic tube 30 and the plug 40 with a second fastener 70;

g) providing the safety sleeve 80 open at the one end 85 thereof;

h) inserting the elastic tube 30, the plug 40, and a portion of the flexible sleeve 50 into the open end 85 of the safety sleeve 80 and fastening the safety sleeve 80 to the flexible sleeve 50 and the at least one end 25 of the flexible strap 20 with a third fastener 90.

The method can further include the steps:

i) forming the flexible strap 25 into the loop 26 such that the at least one end 25 of the flexible strap 20 comprises two opposing ends 25 of the flexible strap 20 aligned together and in mutual contact;

j) attaching an implement to the loop 26, the implement taken from the group of implements comprising: a carabiner 140, a handle 105, a metallic ring 160, and a hook 170.

The method is repeated with the second end 35 of the elastic tube 30 to form the elastic cord 11 (FIGS. 5-8).

While a particular form of the invention has been illustrated and described, it will be apparent that various modifications can be made without departing from the spirit and scope of the invention. For example, the shape of the plug 40, the enlarged head 48 of the plug 40, the second fastener 70, the stitching pattern 105, or the like may all be altered from that illustrated in the drawings. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A connection arrangement between at least one end of a flexible strap and a proximal end of an elastic tube, the connection arrangement comprising:

a plug adapted for insertion into the proximal end of the elastic tube, the plug having a tapered distal end and a proximal end having an enlarged head sized such that the proximal end of the elastic tube is stretchable over the enlarged head;

a flexible sleeve open at a distal end thereof and at a proximal end thereof, the distal end of the flexible sleeve adapted for receiving the proximal end of the plug and the proximal end of the elastic tube therein, and the proximal end of the flexible sleeve adapted for receiving the at least one end of the flexible strap therein and fixed thereto with a first fastener;

a second fastener adapted for crimping the distal end of the flexible sleeve to the proximal end of the elastic tube and the plug between the tapered distal end of the plug and the enlarged head of the plug, thereby connecting the at least one end of the flexible strap with the elastic tube; and a safety sleeve disposed over the elastic tube, the plug, and at least a portion of the flexible sleeve, the safety sleeve fixed to the flexible sleeve with a third fastener.

2. The connection arrangement of claim 1 wherein the tapered distal end of the plug is generally bullet shaped, having a proximal cylindrical section and a distal tapered section having an increasing taper to the tapered distal end of the plug.

3. The connection arrangement of claim 2 wherein the cylindrical section of the tapered distal end of the plug is at least twice as long as the tapered section of the tapered distal end of the plug.

4. The connection arrangement of claim 1 wherein the enlarged head of the plug is generally cylindrical in shape with rounded edges.

5. The connection arrangement of claim 1 wherein the first fastener includes threaded stitching.

6. The connection arrangement of claim 5 wherein the threaded stitching includes an X-box stitch.

7. The connection arrangement of claim 1 wherein the first fastener includes a sonic weld between the at least one end of the flexible strap and the flexible sleeve.

8. The connection arrangement of claim 1 wherein the first fastener includes an adhesive.

9. The connection arrangement of claim 1 wherein the second fastener includes a metallic crimp ring.

10. The connection arrangement of claim 1 wherein the third fastener includes threaded stitching.

11. The connection arrangement of claim 10 wherein the threaded stitching of the third fastener includes an X-box stitch.

12. The connection arrangement of claim 1 wherein the third fastener includes a sonic weld between the at least one end of the flexible strap, the flexible sleeve, and the safety sleeve.

13. The connection arrangement of claim 1 wherein the third fastener includes an adhesive.

14. The connection arrangement of claim 10 wherein the first and third fasteners are unitary threaded stitching.

15. The connection arrangement of claim 14 wherein the unitary threaded stitching of the first and third fastener includes an X-box stitch.

* * * * *